United States Patent [19]

Jensen

[11] 4,241,557

[45] Dec. 30, 1980

[54] CONSTRUCTION MEMBER AND PLATE THEREFOR

[75] Inventor: Keith A. Jensen, Sandy, Utah

[73] Assignee: Jensen Building Products, Inc., Pleasant Grove, Utah

[21] Appl. No.: 906,067

[22] Filed: May 15, 1978

[51] Int. Cl.[2] ..... E04C 3/02

[52] U.S. Cl. ..... 52/696; 52/DIG. 6; 52/693

[58] Field of Search ..... 52/690, 729, 730, 809, 52/691, 692, 693, 694, 695, 696, DIG. 6, 644, 639, 640, 641, 642, 643

[56] References Cited

U.S. PATENT DOCUMENTS

| | | | |
|---|---|---|---|
| 1,358,080 | 11/1920 | Jones | 52/731 |
| 1,649,226 | 11/1927 | Gstalder | 52/DIG. 6 |
| 1,688,016 | 10/1928 | Klaasen | 52/731 |
| 3,298,151 | 1/1967 | Jureit | 52/644 |
| 3,461,636 | 8/1969 | Hern | 52/690 |
| 3,538,668 | 11/1970 | Anderson | 52/809 |
| 3,736,718 | 6/1973 | Sylvan | 52/DIG. 6 |
| 4,078,352 | 3/1978 | Knowles | 52/693 |

FOREIGN PATENT DOCUMENTS

| | | | |
|---|---|---|---|
| 841501 | 6/1952 | Fed. Rep. of Germany | 52/696 |
| 1073305 | 6/1967 | United Kingdom | 52/696 |

*Primary Examiner*—John E. Murtagh

*Attorney, Agent, or Firm*—Thorpe, North & Gold

[57] ABSTRACT

The invention comprises an improved construction member and a plate therefor wherein the construction member comprises an upper and a lower chord preferably interconnected by a web or strut and rigidly joined by a perpendicular spacer lock plate or plurality of plates or by a combination of a perpendicular rectangular spacer guide plate and opposing lock plates. The novel spacer lock plate adds considerable strength and stability to the construction member.

15 Claims, 23 Drawing Figures

FIG. 1
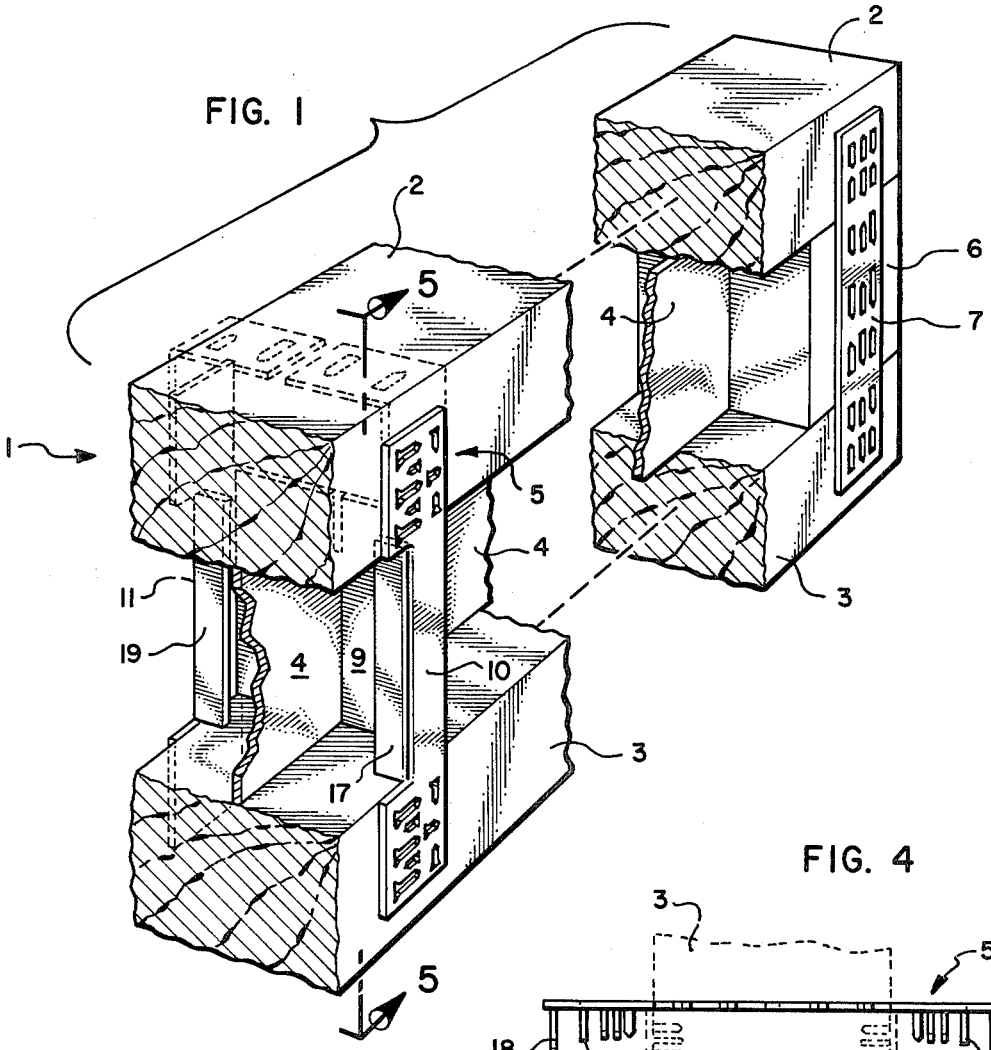
FIG. 4
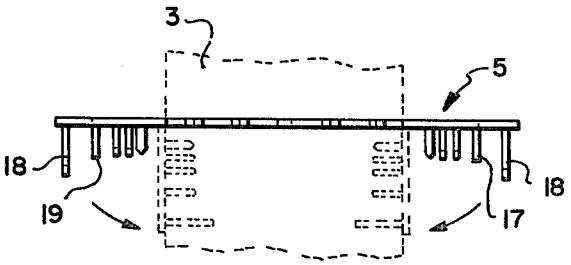
FIG. 5
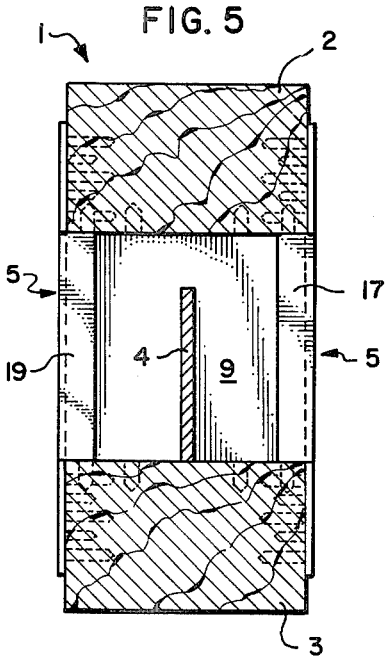
FIG. 3
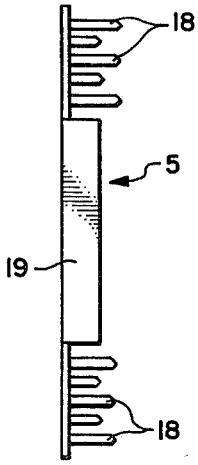
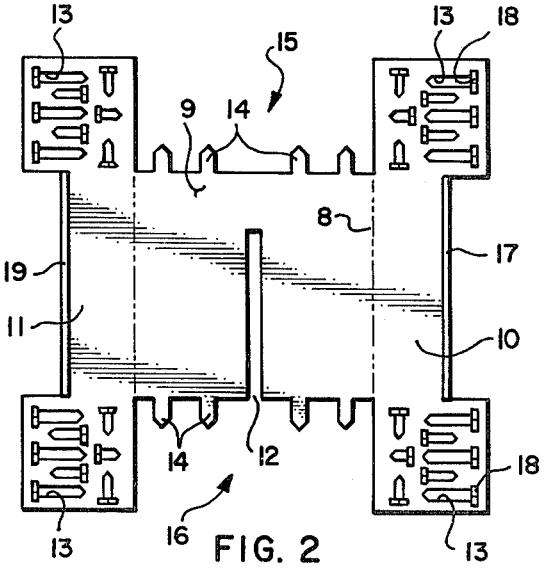
FIG. 2

FIG. 20
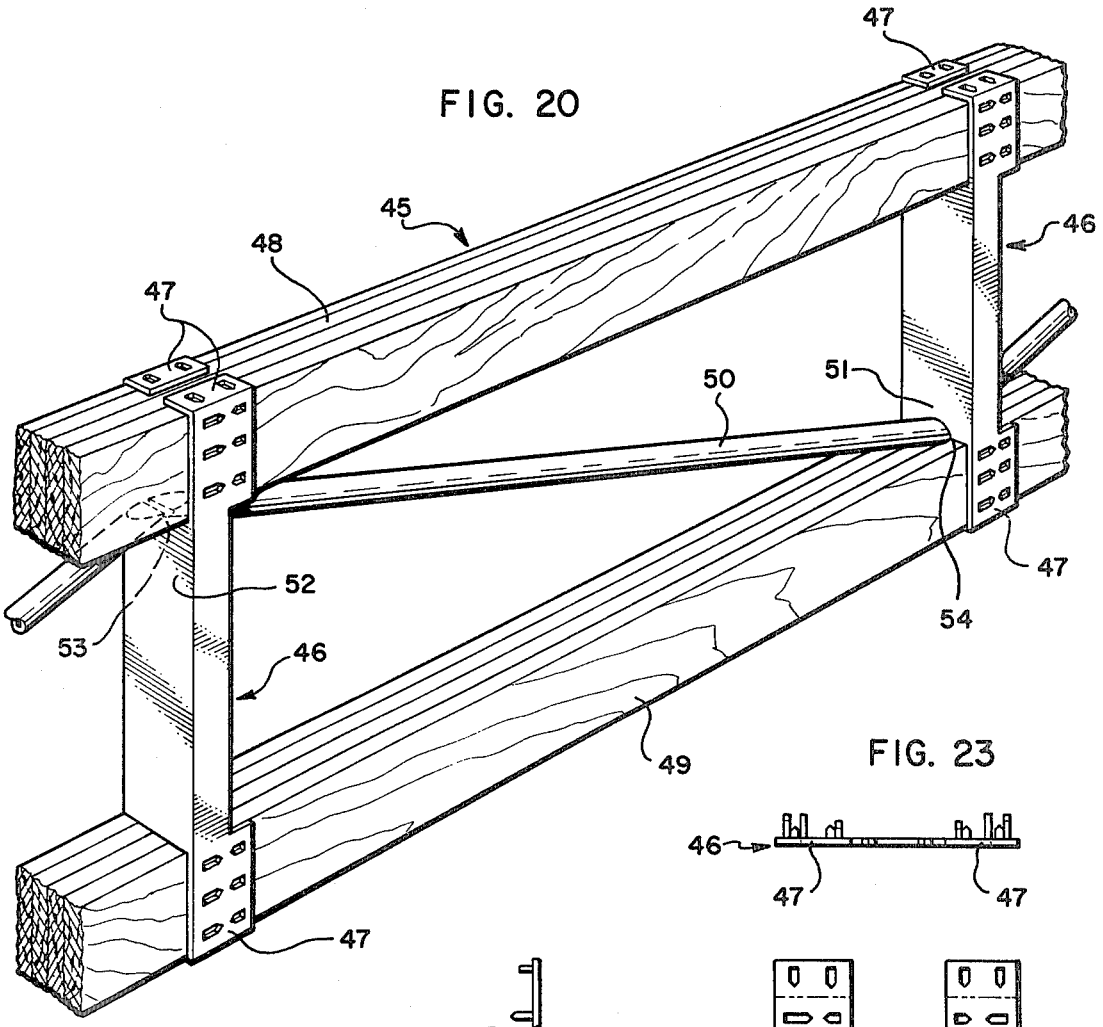
FIG. 23
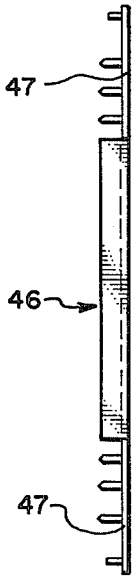
FIG. 22
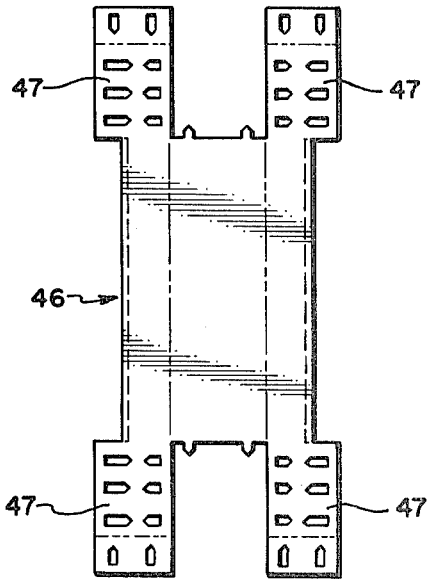
FIG. 21

CONSTRUCTION MEMBER AND PLATE THEREFOR

This invention relates to studs, trusses, and similar construction members, and more particularly (a) to a construction member comprising upper and lower chords preferably interconnected by a web or strut and rigidly joined by a perpendicular spacer lock plate or plurality of plates or by a combination of a perpendicular rectangular spacer guide plate and opposing lock plates, and (b) to the spacer lock plate itself.

BACKGROUND OF THE INVENTION

Construction members such as studs and trusses are becoming increasingly expensive and generally require heavy, solid lumber, such as in a common "two-by-four" or "two-by-six." As the construction members become larger, the costs escalate greatly. Moreover, wood is in relatively short supply and it would be desirable to use less wood or substitutes for wood in a given construction member. It also would be desirable to provide larger construction members at costs relatively comparable to those for smaller members. It further would be desirable to provide construction members which can be made easily into different lengths and widths, which are light in weight, which are straight, and which allow for easy passage of wiring, plumbing, and insulation. These advantages and others described below are provided by the present invention.

Studs or trusses having an upper and lower chord interconnected by a web and/or a connector plate are known; see, for example, U.S. Pat. Nos. 3,298,151 and 3,849,963. However, neither of these patents disclose a construction member having upper and lower chords rigidly joined by a plate (hereafter termed a spacer lock plate), a portion of which runs across the entire width of the chords in a direction perpendicular to the axis of the chords. This perpendicular portion of the plate substantially increases the strength and rigidity of the construction member. In addition, the spacer lock plate of the present invention can be easily inserted and rigidly fastened during manufacture of the construction member. Other advantages are described in the detailed description below.

SUMMARY OF THE INVENTION

This invention is a construction member comprising an upper chord and a lower chord optionally interconnected by a web and rigidly joined by a flat spacer plate or a plurality of plates each positioned in a direction perpendicular to the axis of the chords. The spacer lock plate "spaces" and "locks" the chords apart, hence its name, and has opposing upper and lower rectangular indentations of its upper and lower edges, respectively, into which indentations the upper and lower chords rest. A stem portion is between the indentations and forms the portion of the spacer lock plate that is in a direction perpendicular to the axis of the chords. At each side of the indentations and stem portion, the spacer lock plate contains flanges that are folded flush against the sides of the chords in a direction parallel to the axis of the chords. Each of the flanges has preferably a rectangular portion intermediate of its edge folded inwardly toward the stem portion and interconnecting the upper and lower chords so as to provide additional support between the chords. The flanges are connected to the upper and lower chords either by teeth punched out of and extending perpendicular from the flanges into the chords or by nails or other pegs which are driven through the flanges and into the chords. If present, the web passes through the perpendicular stem portion of the spacer lock plate by means of mutually engaging slots in both the web and spacer lock plate.

A variation of the above construction member comprises replacement of the single web with a pair of webs—an upper web connecting the upper chord and resting in an upper slot of the spacer lock plate, which slot extends from the upper indentation into the stem portion, and a lower web similarly resting in a lower slot and connecting the lower chord.

Another variation comprises replacing the perpendicular stem portion of the spacer lock plate with a rectangular spacer guide plate which is firmly held between the chords and in a perpendicular relationship to the axis of the chords by a pair of opposing lock plates which engage the exposed edges of the spacer guide plate. These lock plates comprise an elongated flat strip having intermediate rectangular portions of its longer edges folded inwardly toward the spacer guide plate, which is positioned preferably tightly between the rectangular portions. The rectangular portions also interconnect the chords to provide additional support between the chords. The two ends of the lock plates are placed flush against the sides of the upper and lower chords and are connected to the chords by punched out teeth driven into the chords or by nails or other pegs driven through the ends into the chords. Optionally, a web interconnecting the upper and lower chords and being generally positioned along the axis of the chords extend through the spacer guide plate by means of mutually engaging slots in both the web and spacer guide plate.

The invention also comprises the above-described spacer lock plate which is used for rigidly joining the upper and lower chords in the manner described.

A strut can be used instead of the web. The strut (or struts) which generally runs the length of the axis of the chords, diagonally interconnects the upper and lower chords and is alternatively disposed between the upper chord and the stem portion defining the upper identation and the lower chord and the stem portion defining the lower indentation.

Each end of the construction member preferably contains end spacer blocks disposed between and interconnecting the ends of the upper and lower chords and secured in place by a truss. The end spacer blocks may be bisected by the web, if it runs the entire length of the chords, or the web may end at the end spacer blocks.

The chord members can be manufactured from a variety of materials. The spacer lock plate is preferably sheet metal, although other materials having similar properties could be used.

BRIEF DESCRIPTION OF THE DRAWINGS

FIG. 1 is a broken perspective view of a construction member in which an upper chord and a lower chord are interconnected by a web and rigidly joined by a spacer lock plate. Also shown in one end of the construction member with interconnecting end spacer blocks and securing truss. The FIG. 6 embodiment is shown in phantom.

FIG. 2 is a front elevational view of a spacer lock plate of the present invention prior to bending of flanges.

FIG. 3 is a side elevational view of the spacer lock plate of FIG. 2.

FIG. 4 is a top elevational view of the spacer lock plate of FIG. 2 showing flanges in bent position (in phantom).

FIG. 5 is a sectional view of the construction member taken along the line 5—5 of FIG. 1.

FIG. 20 is a perspective view of a construction member containing a strut instead of a web.

FIG. 21 is a front elevational view of the spacer guide plate shown in FIG. 20.

FIG. 22 is a side elevational view of the spacer guide plate shown in FIG. 20.

FIG. 23 is a top elevational view of the spacer guide plate shown in FIG. 20.

DETAILED DESCRIPTION OF THE INVENTION

Figures 6, 7, 8, 9, 10, 11, 12:
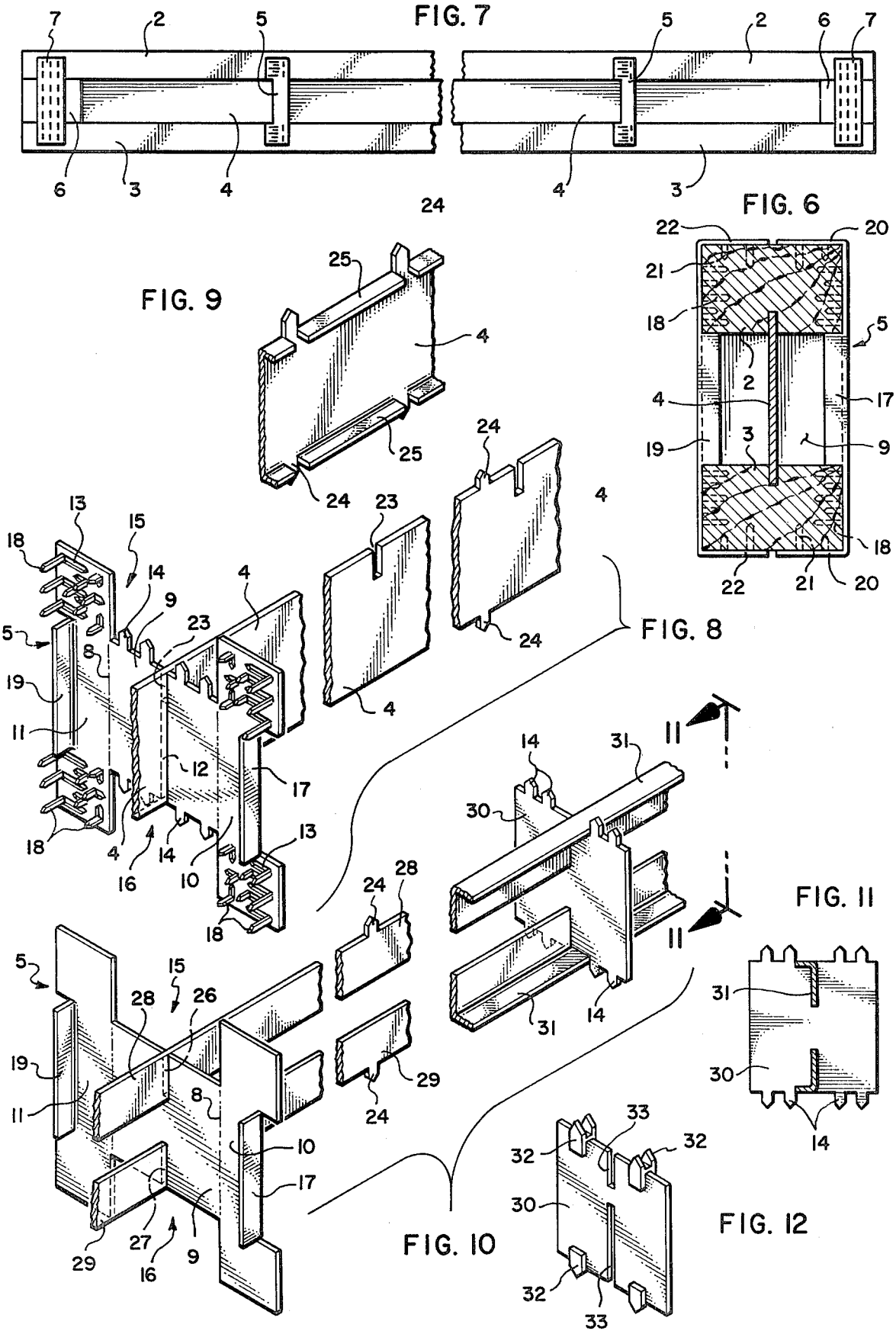
FIG. 6 is a sectional view similar to FIG. 5 but showing a modified spacer lock plate, which also is shown in phantom in FIG. 1.
FIG. 7 is a broken side elevational view of a construction member of the present invention.
FIG. 8 is a broken pictorial view of a spacer lock plate and web combination.
FIG. 9 is a broken pictorial view of a web variation.
FIG. 10 is a broken pictorial view of a spacer lock plate and dual web combination and of a spacer guide plate and dual web combination.
FIG. 11 is a sectional view of the spacer guide plate and dual web combination taken along the line 11—11 of FIG. 10.
FIG. 12 is a pictorial view of a spacer guide plate with H-clamps.

In reference to FIG. 1, the construction member 1 of the present invention comprises an upper chord 2, a lower chord 2, a web 4, a spacer lock plate 5, and, optionally, end space block 6. Also shown is a truss 7.

The chords 2 and 3 preferably are composed of wood of desired size. However, other materials can be used such as plywood, chip-board, fiberboard, extruded plastics such as polyethylene and polyurethane, extruded expanded rubber, and similar materials. End spacer block 6 also can be composed of these materials. Because the chords are spaced apart, the construction member is considerably lighter, and in most cases less expensive, than a construction member composed of a unitary, solid material.

The spacer lock plate 5 is shown in detail in FIGS. 2, 3, and 4. The spacer lock plate 5 comprises a flat piece of material such as sheet metal containing a stem portion 9, a first flange 10, a second flange 11, and, optionally, a slot 12, perforations 13, and teeth 14 and 18 (FIG. 3). The stem portion 9 and flanges 10 and 11 define an upper indentation 15 and a lower indentation 16 into which indentations the upper chord 2 and lower chord 3 rest as shown in FIG. 5. As shown in FIGS. 1, 4, and 5, flanges 10 and 11 are folded flush against the side of the chords in a direction parallel to the axis of the chords. Teeth 18 are thus driven into the chords as shown in FIG. 5. The spacer lock plate 5 also contains a first rectangular portion 17 and a second rectangular portion 19, shown in FIGS. 3, 4, and 6, intermediate of the edges of flanges 10 and 11, respectively, which portions are folded inwardly toward the stem portion and interconnect the upper and lower chords. These rectangular portions 17 and 19 provide additional support to that of the stem portion 9 between the upper and lower chords 10 and 11.

FIG. 6 and FIG. 1 in phantom show a modified spacer lock plate in which the flanges extend beyond the top and bottom surfaces of the upper chord 2 and lower chord 3, respectively, and are folded flush to such surfaces. The extensions are shown as first extended flange portion 20 and second extended flange portion 22, and corresponding flange extensions are present on the opposite end. (Extended flange portions also are shown in FIGS. 20 and 21.) Teeth 21 also are shown.

The spacer lock plate 5 preferably is composed of sheet metal such as 18–28 gage galvanized iron. One or more spacer lock plates can be used in a given construction member. However, plastic, fiberglass, or similar materials can be used. The spacer lock plate shown in FIGS. 1–6 contains teeth punched out of and extending perpendicular from the flanges into the upper and lower chords. This is a preferred embodiment; however, nails or similar pegs can be used instead of the punched out teeth. As shown in FIG. 2, the spacer lock plate preferably contains teeth 14 which are pressed into the upper and lower chords as shown in FIG. 5 to provide greater rigidity. The spacer lock plate also preferably contains a slot 12 for mutually engaging a slot in web 4 (see slot 23 in FIG. 8) to allow the web 4 to extend through the stem portion 9 of the spacer lock plate and along the axis of the chords.

The web 4, which is preferably employed, generally has a width considerably less than that of the upper and lower chords 2 and 3 and is composed of material such as wood, plastic, fiberboard, metal, or the like. The use of web 4 greatly increases the strength and rigidity of the construction member.

End spacer block 6, as shown in FIGS. 1 and 7, preferably is used at each end of the construction member. It provides additional rigidity particularly when held in place by a truss plate 7. When a web 4 is present, it generally bisects end spacer block 6. However, end spacer block 6 may be unitary in which event web 4 would extend to but not through the block.

FIG. 8 is a broken pictorial of the spacer lock plate 5 and web 4 combination. This figure shows the slot 12 of the spacer lock plate mutually engaging the slot 23 of the web to allow the web to pass through the spacer lock plate. Optionally, the web 4 may contain teeth 24, as shown, which can extend into the upper and lower chords 2 and 3 for additional rigidity.

FIG. 9 shows a modified web 4 containing a flange 25 upon which the upper chord 2 may rest. As shown a similar flange may rest against the lower chord 3.

FIG. 10, which is a broken pictorial of a modified spacer lock plate 5 and web combination, shows an upper web 28 and a lower web 29 resting in slots 26 and 27 of spacer lock plate 5. The spacer lock plate 5 in FIG. 10 contains no punched out teeth and therefore is designed to be fastened to the upper and lower chords 2 and 3 by nails or similar pegs which would be driven through the wide or end portions of the flanges. Also shown in FIG. 10 is a modified upper web 31 with flange. As an alternative to spacer lock plate 5, a spacer guide plate 30 also is shown. Spacer guide plate 30, in essence, replaces the stem portion 9 of the spacer lock plate 5 and is further illustrated in FIG. 11, which is a sectional view taken along line 11—11 of FIG. 10.

FIG. 12 shows a modified spacer guide plate containing H-clamps 32 rather than teeth for extending into the upper and lower chords. Slot 33 is designed to mutually engage a corresponding slot in the web 4.

Figure 13:
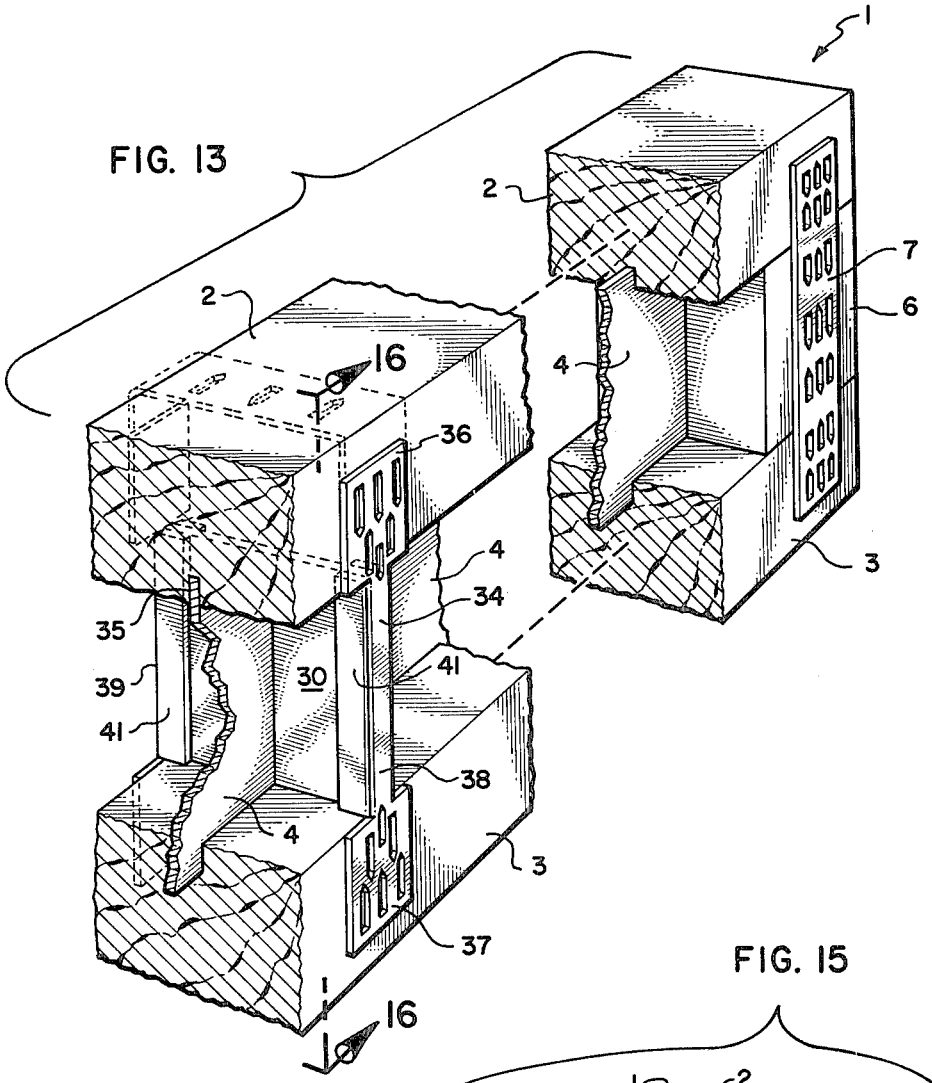
FIG. 13 is a broken perspective view of a construction member having a spacer guide plate and a pair of opposing jack plates. The FIG. 19 embodiment is shown in phantom.

FIG. 13, which is a perspective of a modified construction member, illustrates how the spacer guide plate 30 is locked in place by a lock plate 34 and an opposing lock plate 39. Also shown in FIG. 13 are upper and lower chords having grooves 35 into which the web 4 extends. This configuration provides additional rigidity and strength to the construction member.

Figure 14:
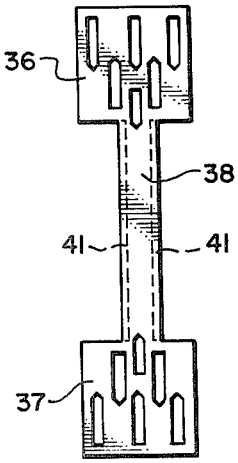
FIG. 14 is a front elevational view of the lock plate of FIG. 13.
Figure 15:
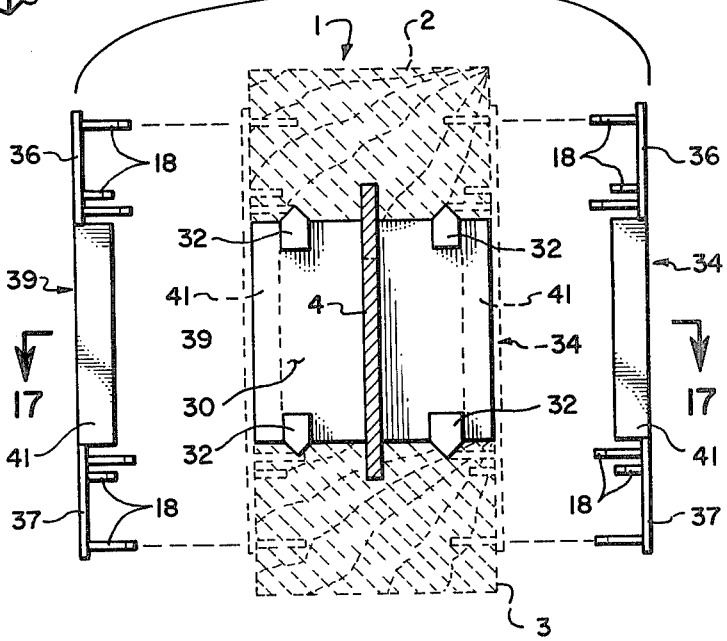
FIG. 15 is a sectional view similar to FIG. 5 showing the spacer guide plate with H-clamps and opposing pair of spacer lock plates (exploded away from construction member) in combination.
Figure 17:
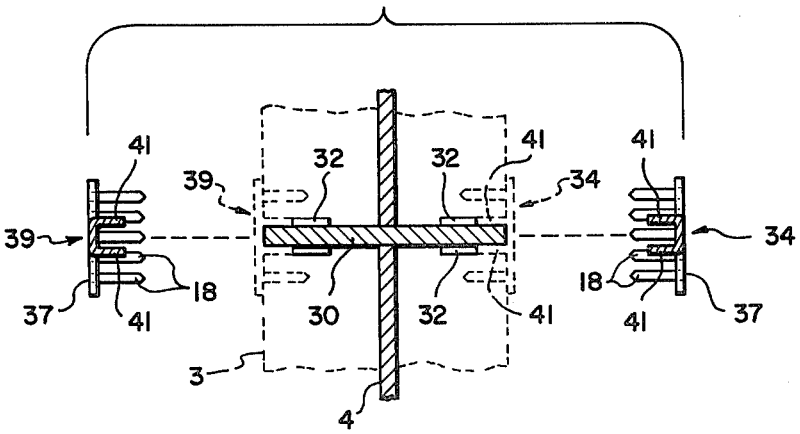
FIG. 17 is a sectional view taken along line 17—17 of FIG. 15.
Figure 16:
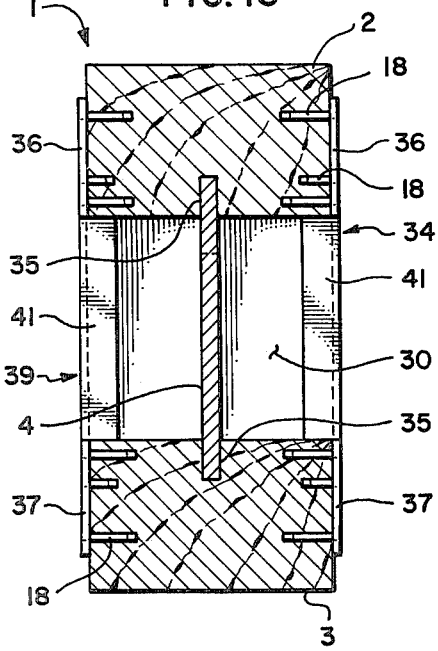
FIG. 16 is a sectional view of a construction member taken along line 16—16 of FIG. 13.

The lock plate 34 is better shown in FIGS. 14 and 15. The spacer lock plate 34 comprises an elongated flat strip containing an upper portion 36 and a lower portion 37 and having two intermediate rectangular portions of its longer edges folded inwardly toward the spacer guide plate and interconnecting the chords as shown in FIG. 13 and in FIG. 16, which is a sectional view taken along line 16—16 of FIG. 13. FIG. 15 illustrates how modified lock plates 34 and 39 are positioned on each side of the spacer guide plate to lock it in place. Rectangular portions 41 hold spacer lock plate 30 tightly in place as shown in FIG. 17, which is a sectional view taken along line 17—17 of FIG. 15.

Figure 18:
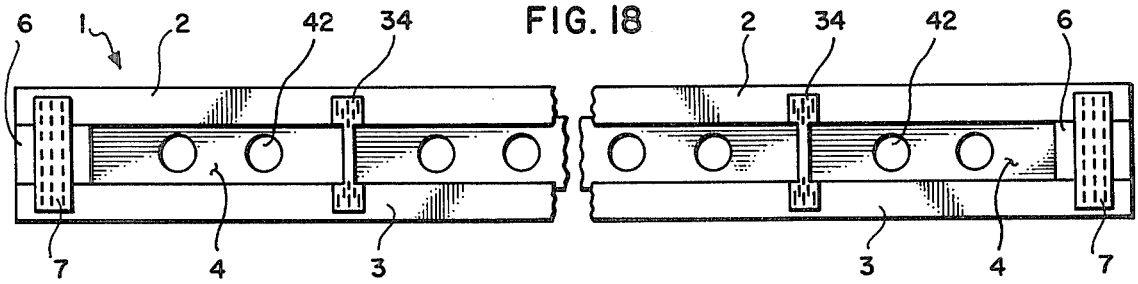
FIG. 18 is a side elevational view of a construction member of the present invention illustrating a web having holes and the use of the spacer lock plate shown in FIG. 14.

FIG. 18 illustrates a preferred embodiment of the invention in that the web 4 contains conveniently spaced apertures 42 through which wiring the plumbing can be passed and insulation can be forced.

Figure 19:
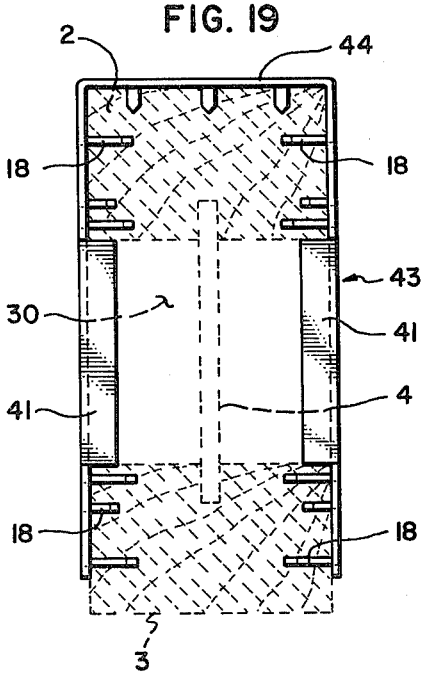
FIG. 19 is a sectional view similar to FIG. 16 showing the opposing pair of spacer lock plates joined at the top of the construction member. The joined plates also are shown in phantom in FIG. 13.

Lock plates 34 and 39 can be joined at the top to form a U-shaped lock plate 43 as shown in FIG. 19 and FIG. 13 in phantom. Lock plate 43 is simply lock plates 34 and 39 connected by a top portion 44.

FIG. 20 is a perspective view of a modified construction member 45, which contains an upper chord 48 (illustrated as being composed of plywood), a lower chord 49, an elongated spacer lock plate 46 having an extended flange portions 47, and a strut 50 which diagonally interconnects the upper and lower chords 48 and 49 and is alternatively disposed bewteen the upper chord 48 and the stem portion 52 defining the upper indentation 53 and the lower chord 49 and the stem portion 51 defining the lower indentation 54.

FIGS. 21, 22, and 23 illustrate the elongated spacer lock plate 46 shown in FIG. 20.

Although several modifications and different embodiments have been described above, other embodiments will be apparent to those skilled in the art. For example, the web 4 could have a bonding agent applied to its edges so that it would adhere to the chords 2 and 3. Similarly, the web could be adhesively bonded to the groove 35. Another embodiment is to press the upper and lower chords 2 and 3 toward each other prior to driving the teeth of the spacer lock 5 into the chords so that the edges of the web depress or indent the surface of the chords thereby forming a small groove or indentation which restricts movement of the web.

Several major advantages of the invention have been described previously, but there are still others. By aligning the web along the axis of each chord, the resulting construction member will be formed straight. Oftentimes, studs formed from solid materials such as wood are not straight or become easily warped. The formation of straight construction members is another advantage of the present invention, and a spacer lock plate 5 materially aids in maintaining the straightness of the construction member. Another advantage of the construction member is that it has greater degrees of soundproofing and insulating qualities. This is because the air space between the chords is a poor conductor of sound and heat. Conventional solid studs will conduct sound and heat between rooms walls to a significantly greater degree. In construction members of the present invention having an apertured web 4 or containing no web, insulation can be blown around or through each construction member. This further increases the insulating ability of the construction member. By using the construction member as top and bottom horizontal plates in addition to vertical studs, insulation can be easily and conveniently blown through the top studs and throughout a studded wall.

The construction members can be made in any width or length simply by using larger spacer lock plates 5 and webs 4. Relatively long or continuous members can be formed by placing chords end to end and connecting them with end spacer blocks 6 and trusses 7. Moreover, the construction members can be conveniently sized on-site simply by cutting to the length desired and securing the two chord ends by trusses, end spacer blocks and trusses, or spacer lock plates. Further, the construction members can be manufactured in a continuous process, for example, by continuously bringing all of the elements together on a conveyor system and running the member through a roller press which would automatically fold the flanges 10 and 11 of the spacer lock plate 5 flush to the sides of chords 2 and 3 and simultaneously drive the teeth 18 of the flanges onto the chords. Contiguous pairs of end spacer blocks and trusses could be inserted where desired, and then by cutting between the pairs, finished ends of the construction members would result.

If the chord of the construction member that will be exposed to the interior of a room or to outside coverings is covered with metal foil or other noncombustible material, the construction member provides fire retardation. This is a feature of major importance and makes the construction member very desirable for use in mobile home construction, along with its lightweight and insulating properties.

While the present invention has been described with reference to certain illustrative examples and preferred embodiments, various modifications are intended to be within the scope of the invention as set forth in the appended claims.

What is claimed is:

1. A construction member comprising an upper chord;

a lower chord;

a flat spacer lock plate or plurality of plates rigidly joining the upper and lower chords, each spacer lock plate positioned in a direction perpendicular to the axis of the chords and having opposing upper and lower rectangular indentations of its upper and lower edges, respectively, into which indentations the upper and lower chords rest, a stem portion between the indentations which includes teeth on the upper and lower edges thereof, and flanges at each side of the indentations and stem portion and folded flush against the sides of the chords in a direction parallel to the axis of the chords; and protrustions extending from or through the flanges and driven into the chords.

2. A construction member according to claim 1 wherein each of the flanges has a rectangular portion intermediate of its edge folded inwardly toward the stem portion and interconnecting the upper and lower chords.

3. A construction member according to claim 1 wherein the spacer lock plate contains teeth punched out of and extending perpendicular from the flanges into the upper and lower chords.

4. A construction member according to claim 1 wherein the flanges are rectangular and have a length such that when folded flush to the chords, the top and bottom edges of the flanges extend beyond the top and bottom surfaces of the upper and lower chords, respectively, and are folded flush to such surfaces.

5. A construction member comprising:

an upper chord;

a lower chord;

a flat spacer lock plate rigidly joining the upper and lower chords, the spacer lock plate positioned in a direction perpendicular to the axis of the chords and having opposing upper and lower rectangular indentations of its upper and lower edges, respectively, into which indentations the upper and lower chords rest, a stem portion between the indentations and flanges at each side of the indentations and stem portion and folded flush against the sides of the chords in a direction parallel to the axis of the chords;

protrusions extending from or through the flanges and driven into the chords; and a web interconnecting the upper and lower chords and being generally positioned along the axis of the chords with the web extending through the stem portion of the spacer lock plate by means of mutually engaging slots in both the web and spacer lock plate.

6. A construction member according to claim 5 further comprising a pair of end spacer blocks interconnecting each of the ends of the upper chord and lower chord and a truss plate driven into the end spacer blocks and chords at the sides of each of the ends of the chords, the web optionally extending through each end spacer block to the end of the chords thereby bisecting the block or extending only to the end spacer block.

7. A construction member according to claim 5 including an upper groove in the upper chord with an upper edge portion of the web being retained in the upper groove and a lower groove in the lower chord with a lower edge portion of the web being retained in the lower groove.

8. A construction member according to claim 5 wherein an upper and a lower edge of the web contain flanges that are folded flush to the surfaces of the upper and lower chords.

9. A construction member according to claim 5 wherein the web contains teeth at its upper and lower edges which teeth protrude into the upper and lower chords.

10. A construction member according to claim 5 wherein the web contains holes perpendicular to its axis and spaced so as to provide for convenient passage of wiring, plumbing, and other items through the construction member.

11. A construction member comprising:

an upper chord;

a lower chord;

a flat spacer lock plate or plurality of plates rigidly joining the upper and lower chords, each spacer lock plate positioned in a direction perpendicular to the axis of the chords and having opposing upper and lower rectangular indentations of its upper and lower edges, respectively, into which indentations the upper and lower chords rest, a stem portion between the indentations, flanges at each side of the indentations and stem portion and folded flush against the sides of the chords in a direction parallel to the axis of the chords, the flanges having a rectangular portion intermediate of its edge folded inwardly toward the stem portion and interconnecting the upper and lower chords, an upper slot which extends into the stem portion from the upper indentation, and a lower slot which extends into the stem portion from the lower indentation;

protrusions extending from or through the flanges and driven into the chords;

an upper web connecting the upper chord and resting in the upper slot of the spacer lock plate, with the web being generally positioned along the axis of the chord; and a lower web connecting the lower chord and resting in the lower slot with the web being generally positioned along the axis of the lower chord.

12. A spacer lock plate for rigidly joining an upper chord and a lower chord to form a construction member, the spacer lock plate being flat and comprising upper and lower rectangular indentations of its upper and lower edges for receiving the upper and lower chords, respectively, a stem portion between the indentations for positioning in a direction perpendicular to the axis of the chords, flanges at each side of the indentations and stem portion for folding in a direction perpendicular to the stem portion and along the sides of the chords, and a slot or slots extending into the stem portion from the upper and lower indentations or both for receiving a mutually slotted web or a pair of webs, if present, that run in a direction parallel to the axis of the chords and interconnect or connect, respectively, the upper and lower chords.

13. A spacer lock plate according to claim 12 wherein each of the flanges has a rectangular portion intermediate of its edge for folding inwardly toward the stem portion such that the rectangular portion can interconnect the upper and lower chords.

14. A spacer lock plate according to claim 12 wherein the flanges contain teeth punched out of and extending perpendicular from the flanges for driving into the upper and lower chords.

15. A spacer lock plate according to claim 12 wherein the stem portion contains teeth protruding from its upper and lower edges.

* * * * *